US009295903B2

(12) United States Patent
Sheirs et al.

(10) Patent No.: US 9,295,903 B2
(45) Date of Patent: Mar. 29, 2016

(54) LANE MAINTENANCE MACHINE HAVING CONDITIONER AND/OR CLEANER MIXING CAPABILITY

(71) Applicant: Kegel, LLC, Lakes Wales, FL (US)

(72) Inventors: Dennis W. Sheirs, Sebring, FL (US); Mark E. Davis, Sebring, FL (US); John M. Davis, Winter Haven, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 14/216,576

(22) Filed: Mar. 17, 2014

(65) Prior Publication Data

US 2014/0259479 A1 Sep. 18, 2014

Related U.S. Application Data

(60) Provisional application No. 61/794,708, filed on Mar. 15, 2013.

(51) Int. Cl.

| | |
|---|---|
| ***B05B 3/00*** | (2006.01) |
| ***B05B 13/02*** | (2006.01) |
| ***B05C 1/08*** | (2006.01) |
| ***A47L 11/02*** | (2006.01) |
| ***A63D 5/10*** | (2006.01) |

(52) U.S. Cl.
CPC ..... *A63D 5/10* (2013.01)

(58) Field of Classification Search
CPC ..... A63D 5/10
USPC ..... 118/323, 313, 315, 305, 304, 300, 206, 118/207, 262, 264, 268, 302, 692; 15/98, 15/103.5, 320
See application file for complete search history.

(56) References Cited

U.S. PATENT DOCUMENTS

| | | | | |
|---|---|---|---|---|
| 4,980,815 | A * | 12/1990 | Davis | 700/11 |
| 6,923,863 | B1 * | 8/2005 | Baker et al. | 118/207 |
| 2007/0289086 | A1 * | 12/2007 | Davis et al. | 15/340.3 |

* cited by examiner

*Primary Examiner* — Yewebdar Tadesse
(74) *Attorney, Agent, or Firm* — Hovey Williams LLP

(57) ABSTRACT

A bowling lane maintenance machine is provided with separate reservoirs for constituent conditioning components to allow separate storage of the conditioning components and mixing of the conditioning components just prior to application to a surface of the bowling lane. One conditioning component may be a polar component such as a polyethylene glycol and another conditioning component may be a non-polar component such as a mineral oil based product. Separate reservoirs for constituent cleaning components are also provided so that the cleaning components may also be stored separately and then mixed together just prior to application to the bowling lane surface. Primary and secondary drive wheels are positioned on opposite sides of the machine forwardly of a conditioner application roller in the intended forward direction of travel of the machine so that they do not leave "tracks" on the conditioner after its application on the bowling lane.

16 Claims, 6 Drawing Sheets

LANE MAINTENANCE MACHINE HAVING CONDITIONER AND/OR CLEANER MIXING CAPABILITY

BACKGROUND OF THE INVENTION

1. Field of the Invention

The present invention relates to the field of bowling lane maintenance machines; more particularly, it is concerned with a machine having the capability of mixing constituents of lane conditioners and/or cleaning compositions which are held in separate reservoirs within the machine and which may be combined just prior to application, and a related method.

2. Description of the Prior Art

Prior art bowling lane maintenance machines have typically been provided with separate reservoirs for holding lane conditioners and cleaning compositions. By way of example, this arrangement is shown in published U.S. Patent Application No. US 2008/0109983, the entire disclosure of which is incorporated herein by reference. Typically, a lane maintenance machine having the capability of cleaning the lane and then applying a conditioner or treatment to the lane operates by applying the cleaning composition to the lane and then applying the conditioner as a lane dressing. This arrangement has necessitated the lane maintenance machine operator to premix the cleaning compositions and the use of lane conditioners which are of a character that they may be retained in the reservoir for lengthy periods prior to application. Moreover, such lane maintenance machines may require that power be expended to operate portions of the cleaning system simultaneously with the dressing application system. Thus, existing lane maintenance machines have limitations with regard to the types of compositions which can be held in the reservoirs and on the operating characteristics and performance of the machine.

SUMMARY OF THE INVENTION

The present invention provides significant and unconsidered advantages over prior art bowling maintenance machines. In general, the bowling lane maintenance machine of the present invention:

- provides a plurality of separate reservoirs for constituent conditioning components, whereby new conditioning components which must be stored separately and mixed just prior to application may be used;
- provides for a mixing junction to be used with the lane conditioner applicator head whereby separate lines each conveying different conditioning components may be mixed in desired ratios just prior to application;
- provides a plurality of separate reservoirs for constituent cleaning components, whereby a cleaning concentrate may be stored in one of the reservoirs and a diluting agent such as water may be stored in another of the reservoirs to avoid the necessity of a bowling lane maintenance worker premixing the concentrate and diluting agent in a remote location and delivering the mixed composition to a single reservoir;
- provides a mixing junction for the cleaner application head, whereby the concentrate and the diluting agent can be delivered in desired ratios and mixed just prior to application;
- provides for independent control of the cleaner application head separate and apart from the operation of the conditioner application head whereby the cleaner head need not consumer power when not needed to apply cleaning solution to the bowling lane, and independent control of the speed and operation of the cleaner application head and independent volume control;
- provides for positioning the conditioner application location rearward of other components contacting the bowling lane, thereby avoiding "tracking" of wheels or the like on top of the applied conditioner to thereby provide the desired and intended pattern of lane conditioner to the bowling lane unaffected by passage of the maintenance machine;
- provides a lane dressing application system which employs both a strip brush and a roller in combination with an applicator roll or buffer to quickly transfer conditioner to the buffer and avoid insufficient or excessive amounts of conditioner being applied by the buffer to the bowling lane while increasing the useful life of the buffer by decreasing the amount of compression of the brush.

In one particular aspect, the invention is directed to an improvement in a bowling lane maintenance machine comprising a plurality of separate conditioning component reservoirs carried on the machine for separately storing constituent conditioning components, at least one conditioner dispensing head for receiving and then dispensing the constituent conditioning components, at least one pump associated with the separate conditioning component reservoirs and operable to pump the constituent conditioning components from the separate conditioning components reservoirs to the at least one conditioner dispensing head, a buffer for receiving the constituent conditioning components dispensed from the at least one conditioner dispensing head and applying the constituent conditioning components to a bowling lane in a preselected pattern, a cleaning liquid component reservoir carried on the machine for storing a cleaning liquid, at least one cleaning liquid dispensing head for receiving and then dispensing the cleaning liquid, and a control system operably coupled with the at least one pump to and cause the pump to concurrently pump the constituent conditioning components to the at least one conditioner dispensing head to allow concurrent dispensing of each of the constituent conditioning components onto the buffer.

In one embodiment, another conditioner dispensing head is provided and one of said conditioner dispensing heads is fluidically coupled with only one of said conditioning component reservoirs and the other of said conditioner dispensing heads is fluidically coupled with only another one of said conditioning component reservoirs so that said constituent conditioning components are not mixed together prior to being dispensed from said conditioner dispensing heads.

In another embodiment, a mixing junction fluidically is coupled with the separate conditioning component reservoirs for mixing together the constituent conditioning components and delivering the mixed constituent conditioning components to the conditioner dispensing head.

These and other advantages of the improved bowling lane maintenance machine having conditioner or cleaner mixing capability will be appreciated by those skilled in the art with reference to the following description and drawings forming a part of this application.

DESCRIPTION OF A PREFERRED EMBODIMENT

Figure 1:
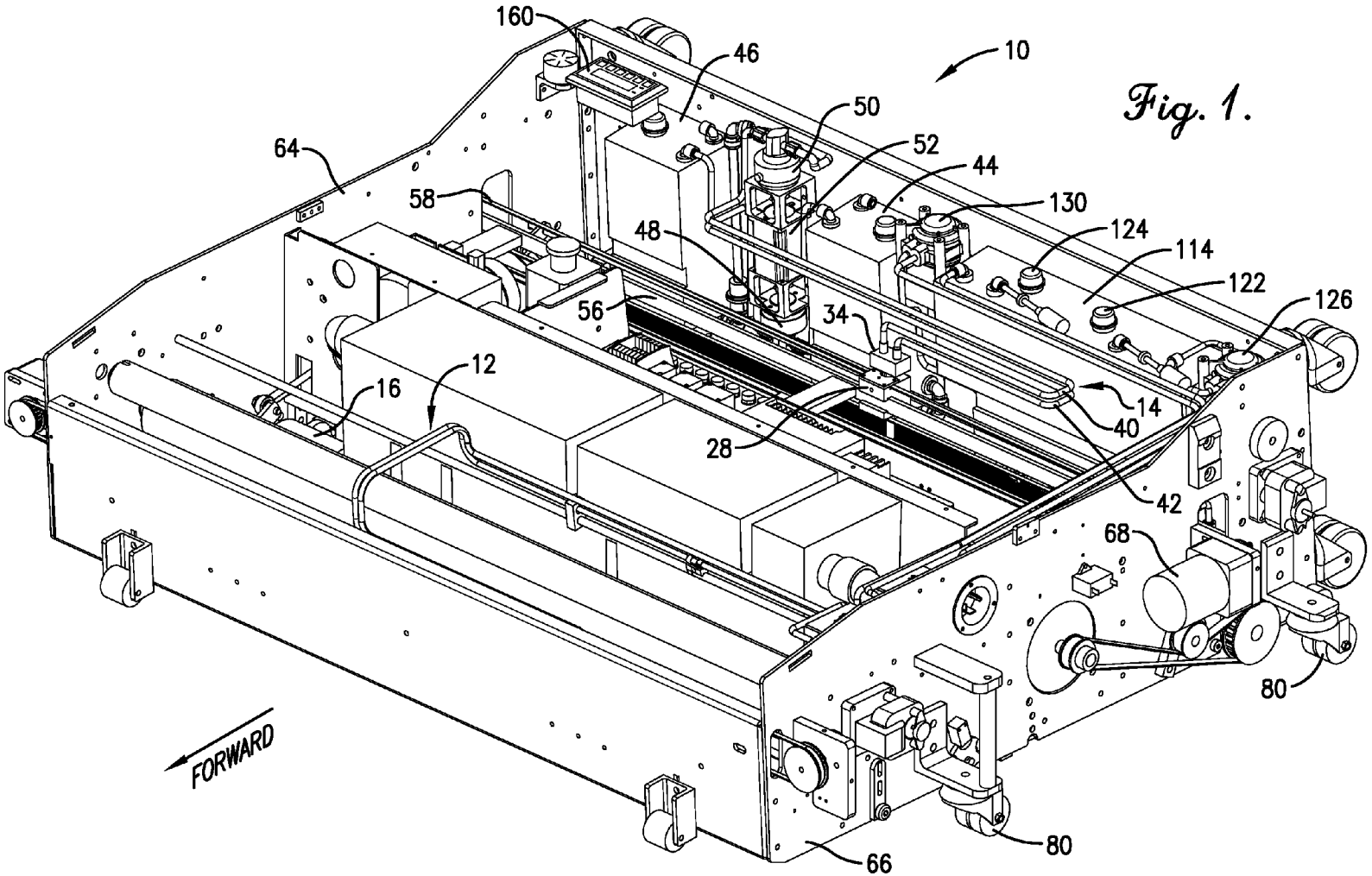
FIG. 1 is a left front perspective view of a bowling lane maintenance machine having conditioner or cleaner mixing capability embodying the principles of the present invention with its top cover removed to reveal internal details of construction.
Figure 2:
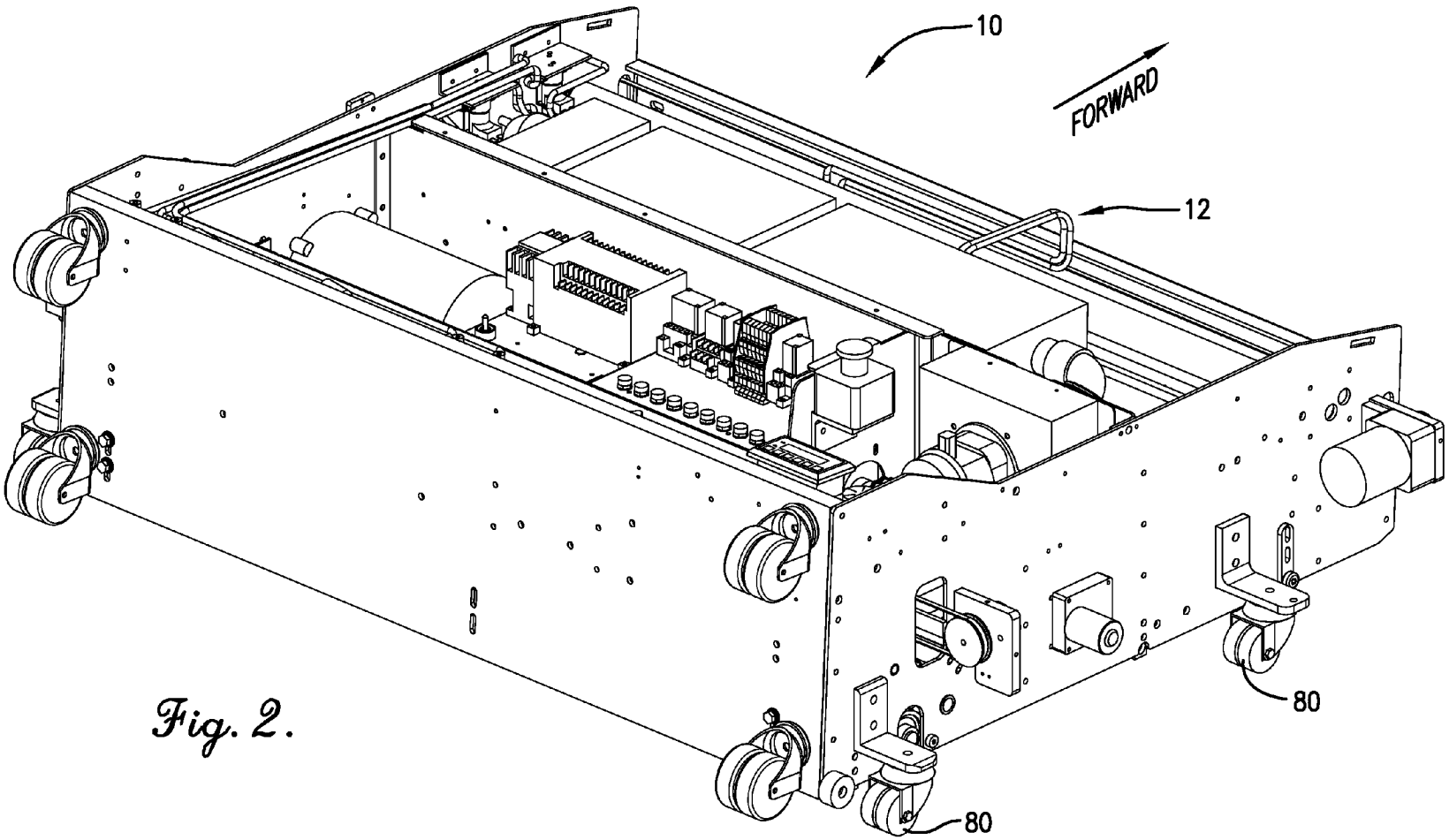
FIG. 2 is a right rear perspective view of the machine hereof.
Figure 3:
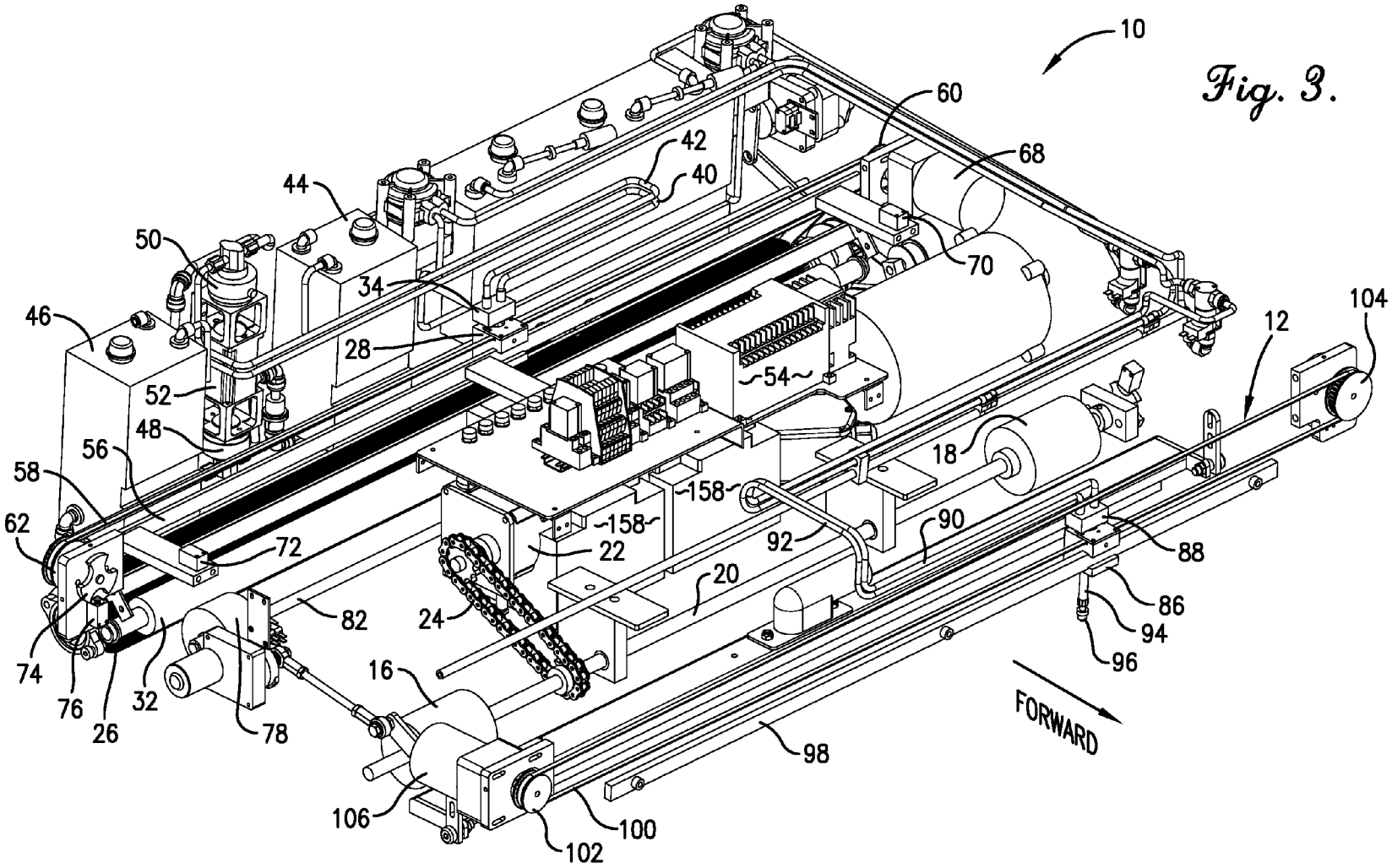
FIG. 3 is a right front perspective illustration of certain internal components of the machine with walls and other structures removed for clarity.
Figure 4:
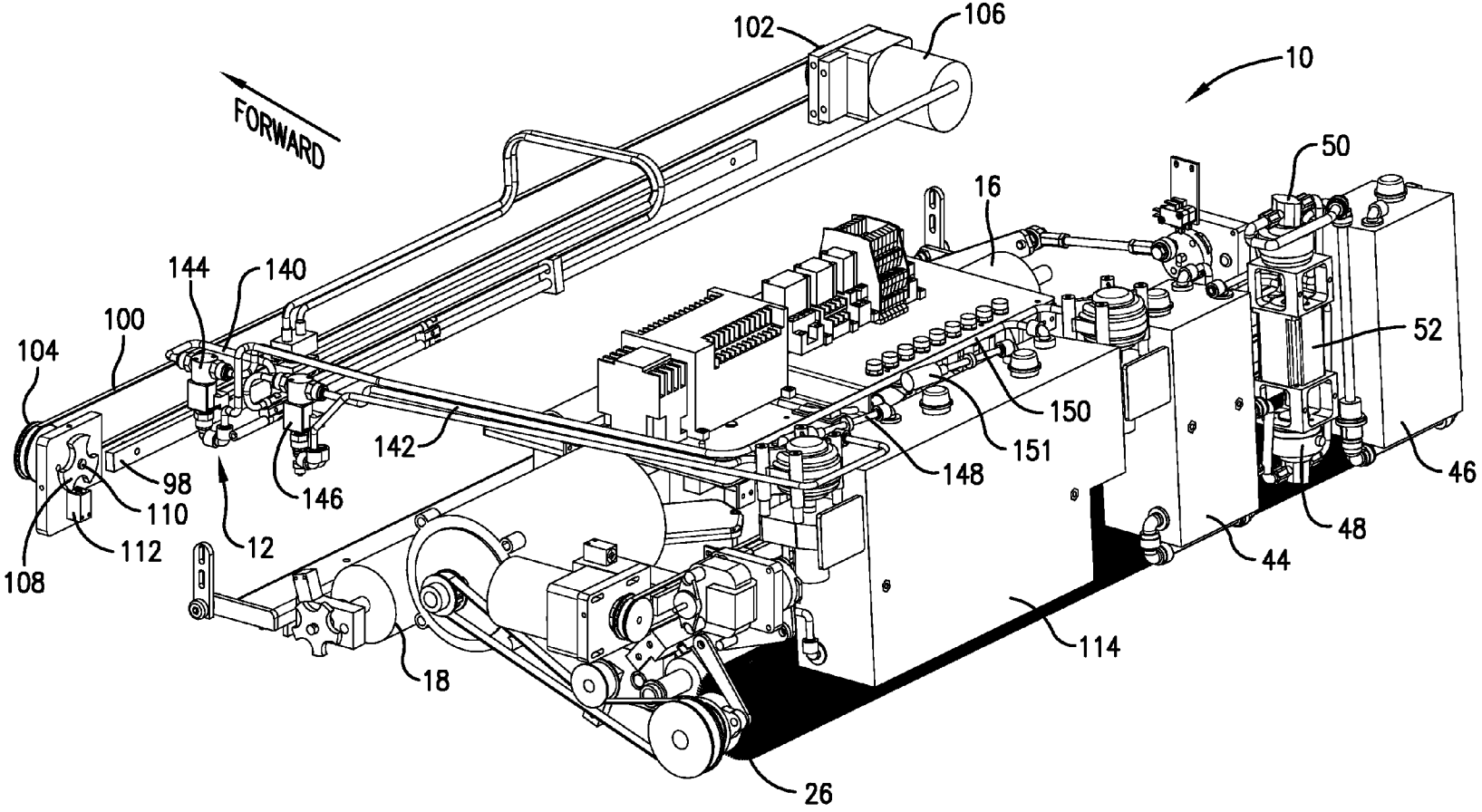
FIG. 4 is a left rear perspective illustration of certain internal components of the machine with walls and other structures removed for clarity.

The present invention is susceptible of embodiment in many different forms. While the drawings illustrate and the specification describes certain preferred embodiments of the invention, it is to be understood that such disclosure is by way of example only. There is no intent to limit the present invention to the particular disclosed embodiment.

A bowling lane maintenance machine having conditioner or cleaner mixing capability 10 illustrated in the drawings is similar in many respects to the machine disclosed in U.S. Pat. No. 5,729,855, U.S. Pat. No. 6,939,404 and Published U.S. Patent Application No. 2008/0109983 A1. Accordingly, the '855 and '404 patents and the '983 published patent application are hereby incorporated by reference in their entirety. In view of the full disclosure in the '855 and '404 patents and the '983 published patent application of the construction and operation of common components, the machine 10 will be described only generally herein.

The machine 10 has a cleaning system denoted broadly by the numeral 12 that is configured to deliver a cleaning composition or solution to a bowling lane generally from the front of the machine 10, the front being that portion of the machine 10 which would be in the forward position as indicated by the direction of travel arrow as shown in FIGS. 1, 2, 3, 4, and 6. A dressing or conditioner application system is denoted broadly by the numeral 14 and located generally in the rear portion of the machine. These two systems perform their functions as the machine is propelled down the lane and back by lane-engaging primary drive wheels 16 and 18 fixed to a transverse shaft 20 that is powered by a drive motor 22, which may be, by way of example only, a Baldor 24 VDC model 24A531ZO19G1, and a chain and sprocket assembly 24. A conventional proximity sensor speed tachometer (not shown) may be coupled with the end of the drive shaft 20.

The conditioner application system 14 includes an applicator roll 26 (herein sometimes referred to as a "buffer") disposed for engaging the bowling lane surface S, a reciprocating conditioner dispensing head 28 that travels back and forth across the width of the lane above buffer 26, a brush assembly 30 between buffer 26 and one or more conditioner dispensing heads 28 for receiving a conditioner such as oil from head 28 and delivering it to the buffer 26, a transfer roller 32, and an optional mixing junction 34 coupled to the dispensing head 28 and traveling therewith. The buffer 26 is positioned generally rearwardly on the machine 10. Preferably, the brush assembly 30 is disposed to intercept dressing dispensed from the dispensing head 28 and transfer it to the buffer 26, and includes at least one strip brush 36 having a dense body of bristles that extends along the full length of buffer 26 directly below and in vertical alignment with the path of travel of the head 28.

Bristles approach buffer 26 at an inclined angle to engage bristles of roll 26 at an inclined angle in an upper portion thereof, preferably at approximately a one o'clock position. Preferably, bristles approach buffer 26 at an approximately 45 degree angle so that the force of gravity is utilized to assist in transferring dressing from bristles to the bristles of buffer 26. Details of construction and manner of use of the brush assembly 30 are disclosed in U.S. Pat. No. 7,056,384, the entire disclosure of which is incorporated herein by reference.

Transfer roller 32 is preferably made of steel or similar durable material and serves to smooth and even out the oil or other dressing applied to the buffer 26. Unlike prior art rollers in engagement with buffers, the transfer roller 32 is sized, configured and positioned to engage the bristles of the buffer 26 without crushing those bristles. That is, the transfer roller 32 does not substantially deflect the bristles of the buffer 26, as the transfer of the lane dressing is effected by the brush assembly 30 and the transfer roller 32 need only smooth and even out the distribution of the oil or other dressing as the buffer 26 rotates, thereby increasing the life of the buffer 26. The buffer 26 may rotatably driven by a buffer motor and may pivot up and down, in and out of contact with the bowling lane surface by a linkage and buffer up/down motor such that in the down position, the buffer 26 engages the bowling lane and operates a buffer down limit switch and in an up position operates a buffer up limit switch as disclosed and described in Published U.S. Patent Application No. 2008/0109983.

The (or each) dispensing head 28 includes an upright, tubular nozzle (not shown) for delivering conditioner to the brush assembly 30 and a block-like holder (not shown). Details of construction of the dispensing head 28 are disclosed in U.S. Pat. No. 7,056,384. In one embodiment, mixing junction 34 is present and may be indirectly or, more preferably, directly coupled to the upper, inlet side of the tubular nozzle of the head 28. The mixing junction 34 thus includes a plurality of inlets to which respective first and second supply hoses 40 and 42 are connected, and an outlet which is fluidically connected to the tubular nozzle of the dispensing head 28. The inlets of the mixing junction 34 lead to a preferably internal, relatively small mixing chamber where the conditioners supplied by the respective supply hoses 40 and 42 intermix and are then delivered to the outlet of the mixing junction 34.

The conditioner application system 14 further includes a first reservoir 44 fluidically coupled with the first supply hose 40 for holding and delivering a first quantity of a lane conditioner component and a second reservoir 46 fluidically coupled with the second supply hose 42 for holding and delivering a second quantity of a different lane conditioner component. The first reservoir 44 may be in fluidic communication, either directly or via a fluid carrying conduit, with a first pump 48, which may be a fluid metering pump or a peristaltic pump, and the second reservoir 46 may be in fluidic communication, either directly or via a fluid carrying conduit, with a second pump 50, which may be a fluid metering pump or a peristaltic pump. The pumps 48 and 50 are preferably driven by a common motor 52, which is preferably a stepper motor, although it is also possible for the pumps 48 and 50 to be driven independently by separate motors (as shown and described herein with regard to the pumps and motors for the cleaning system 12).

In one embodiment, the pumps 48 and 50 are connected by their respective, independent first supply hose 40 and second supply hose 42 to mixing junction 34. By this arrangement, the total volume of conditioner supplied to conditioner dispensing head 28 may be increased or decreased by varying the operation of the pumps 48 and 50. Preferably, each of the pumps 48 and 50, being fluid metering pumps, have an adjustable volume output so that the ratio of the constituent conditioner components delivered to the conditioner dispensing head 28 from the first reservoir 44 and the second reservoir 46 may be adjusted. The adjustable output of each of the pumps 48 and 50 may be manual, or alternatively may be electronically adjusted by a signal delivered from a control system 54 which may include a programmed programmable logic controller (PLC). In this way, the amount of the first conditioner component and the amount of the second conditioner component delivered to the mixing junction 34 via respective first and second supply hoses 40 and 42 may be varied according to the desired ratio of the mixed conditioner composition applied to the bowling lane by the conditioner dispensing head 28.

In another embodiment, the mixing junction 34 is omitted and the supply hoses 40 and 42 from pumps 48 and 50 separately deliver the first quantity of the lane conditioner component from the first reservoir 44 to one conditioner dispensing head 28 and the second quantity of the different lane conditioner component from the second reservoir 46 to another conditioner dispensing head 28. The lane conditioner components are then separately dispensed from the conditioner dispensing heads 28 and are mixed together by action of the buffer. In both embodiments, the pumps 48 and 50 are operable to deliver the first quantity of the lane conditioner component to the conditioner dispensing head 28 concurrently with the delivery of the second quantity of the different land conditioner component to the same or different conditioner dispensing head 28 so that the first and second quantities of the lane conditioner components are concurrently delivered to the buffer 26.

The holder for the (or each) dispensing head 28 may be mounted on a transversely extending, horizontal guide track 56 that extends across the full width of the machine above and parallel to the buffer 26, and an endless belt 58 is operably coupled with the dispensing head 28 for shifting the latter back and forth along the track 56. Belt 58 is entrained around a pair of pulleys (FIGS. 3) 60 and 62 located outboard of opposite sidewalls 64, 66 of the machine 10, the pulley 60 being driven by a reversible motor 68, e.g. a Crouzet 24 VDC model 808050Y07 or a Berger Lahr BRS368H130AAA, that is controlled by a pair of proximity sensors 70, 72 adjacent opposite ends of the path of travel of the dispensing head 28. A notched timing wheel 74 associated with pulley 62 is provided and its rotation is sensed by a sensor 76. An output from sensor 76 is sent to the control system 54 for the purpose of determining the precise location of the conditioner dispensing head 28 across the width of the machine 10 and the bowling lane. Such location is coordinated with a particular oil lane pattern that has been programmed into the control system 54 of the machine 10 so that the dispensing head 28 may be actuated to precisely dispense oil at predetermined locations along its path of reciprocation.

Distance along the bowling lane is determined by a pair of lane engaging distance sensor wheels 78 (FIGS. 3, 6), one of each of the lane engaging wheels 78 being positioned at each side of the machine 10. The lane engaging distance sensor wheels 78 are positioned forwardly of the buffer 26 in the intended forward direction of travel so that they engage the bowling lane prior to the application of conditioner by the buffer 26 and do not leave "tracks" on the conditioner after its application in the desired pattern on the bowling lane. While gutter guide wheels 80 are positioned rearwardly of the buffer 26, they are spaced and positioned so that they travel in the gutters outboard of the bowling lane and thus do not engage the surface of the bowling lane after the application of conditioner by the buffer 26. Lane engaging distance sensor wheels 78 are fixed to a common cross shaft 82 that rotates a notched wheel (not shown) via a chain drive 84. The number of revolutions of the notched wheel is detected by a sensor (not shown) that sends a signal to the control system 54 of the machine 10. In an alternative embodiment, the distance sensor wheels 78 may alternatively or additionally function as secondary drive wheels for the machine 10. When the distance sensor wheels 78 function only as secondary drive wheels, an alternative lane distance sensing mechanism is used.

The cleaning system 12 includes one or more cleaning liquid dispensing heads 86 that reciprocate across the path of travel of the machine 10 as it moves along the bowling lane. While system 12 may include one or more pressurized spray nozzles as in conventional machines, in a preferred embodiment no such conventional spray nozzles are utilized. In the particular embodiment disclosed herein, only a single dispensing head 86 is utilized, such dispensing head 86 traveling essentially the full transverse width of the machine to the same extent as the conditioner dispensing head 28. As with conditioner dispensing head 28, the cleaning liquid dispensing head 86 may be provided with a mixing junction 88 which includes an internal mixing chamber and a pair of inlets for receiving separate and independent cleaning liquid constituent components from separate cleaning system supply hoses 90 and 92. The mixing junction 88 may be located near the cleaning liquid dispensing head 86 as illustrated in the drawings, or it may be positioned remotely from the cleaning liquid dispensing head 86.

Cleaning liquid dispensing head 86 may include a vertically disposed, depending discharge tube 94 provided with a tip 96 (FIG. 3) that is located close to the lane surface. While the tip 96 could be provided as an atomizing nozzle, in a preferred form of the invention, tip 96 is not in the nature of an atomizing nozzle but is instead configured and arranged to emit liquid in a fairly coherent stream so that a bead of cleaning liquid is laid down on the lane surface. One suitable tip 96 for carrying out this particular non-atomizing function is available from the Value Plastics Company of Fort Collins, Colo. as part number VPS5401001N. Other types of tips, not shown, that atomize, breakup or diffuse liquid supplied to the tip may also be used where a broader surface area coverage by the cleaning liquid is desired. In either case, tip 96 is preferably provided with an internal check valve (not shown).

Cleaning system 12 further includes a guide track 98 attached to or adjacent a front wall of the machine 10 that slidably supports cleaning liquid dispensing head 86 for reciprocal movement. Track 98 extends across substantially the entire width of machine 10 to the same extent as the track 56 associated with the conditioner dispensing head 28. An endless drive belt 100 is attached to the cleaning liquid dispensing head 86 for providing reciprocal drive thereto, the belt 100 at its opposite ends being looped around a pair of pulleys 102 and 104 respectively.

In one embodiment disclosed herein, pulley 102 is driven by a motor 106 which is preferably a reversible motor, for example a Crouzet 24 VDC model 808050Y07 or a Berger Lahr BRS368H130AAA. The provision of motor 106, which is operated by a signal from control system 54, thus does not mechanically link the operation of the conditioner dispensing head 28 to the cleaning system dispensing head 86 so that each may operate independently of the other and avoid the necessity of simultaneous reciprocation, thereby reducing wear and power consumption when only one of the dispensing heads 28, 86 is in operation. A notched wheel 108 is coupled to the pulley 104 by shaft 110, the rotation of the notched wheel 108 being sensed by a sensor 112 which sends a signal to the control system 54 for determining the precise location of the cleaning liquid dispensing head 86 as it moves along the guide track 98. In another embodiment, motor 106 is omitted and motor 68 is used to operate both the conditioner dispensing head 28 and the cleaning system dispensing head 86.

Figure 5:
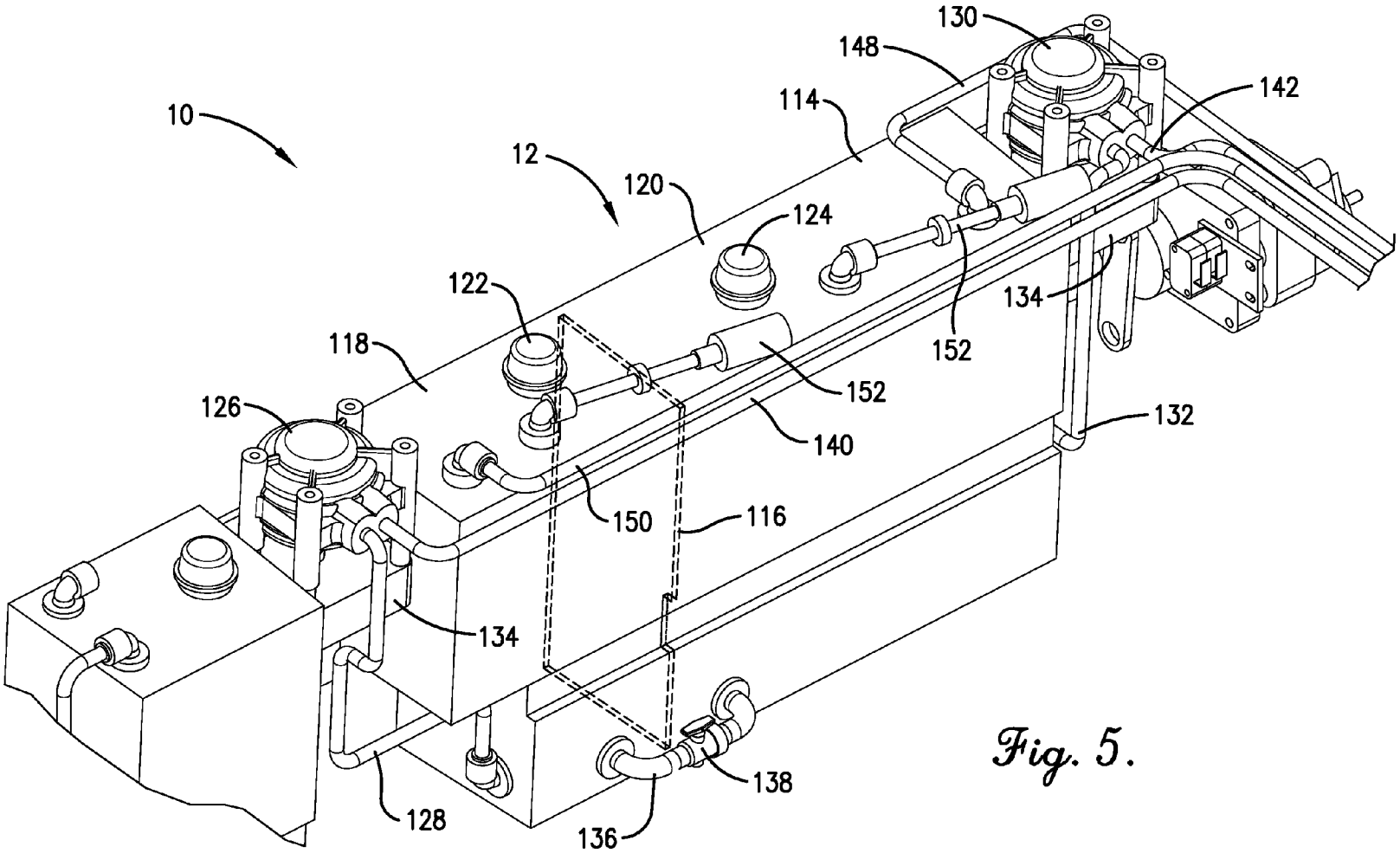
FIG. 5 is an enlarged, fragmentary right front perspective illustration of certain components of the machine as shown in FIG. 3, with an internal barrier within the cleaner tank provided in broken lines to illustrate the separate reservoirs for the constituent components of the cleaning composition.
Figure 6:
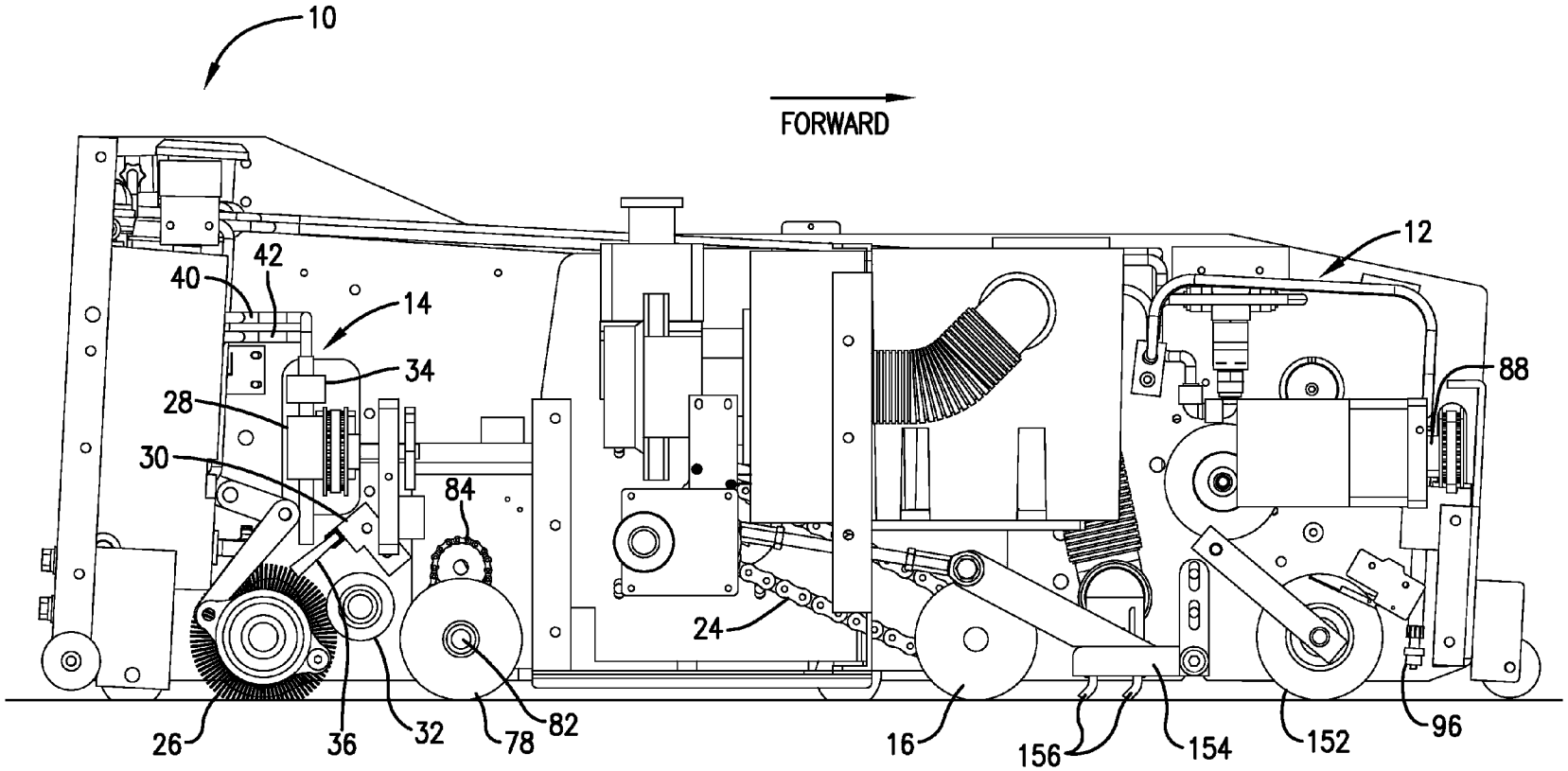
FIG. 6 is a right side elevation view of the machine with the near sidewall thereof removed to reveal internal details of construction and the positioning of the lane distance sensor wheels forwardly of the buffer.

Cleaning system 12 further includes a tank 114 which includes an interior dividing wall 116, separating tank 114 into a third reservoir 118 and a fourth reservoir 120 (FIG. 5). The tank 114 includes separate filler inlets 122 and 124 for respectively filling third reservoir 118 and fourth reservoir 120 with cleaning liquid components. The dividing wall 116 may preferably be positioned within the tank 114 so that the third reservoir 118 has a smaller volume than fourth reservoir 120. This arrangement is advantageous where the third reservoir 118 may be filled with a bowling lane cleaning solution concentrate, for example Kegel Defense-C lane cleaner concentrate, and the fourth reservoir 120 filled with a diluting agent such as water. The third reservoir 118 is fluidically coupled to a pump 126 either directly or by a fluid-conveying conduit 128 as shown, and the fourth reservoir 120 is fluidically coupled to a pump 130 either directly or by a fluid conveying conduit 132.

Each pump may be driven by its own motor 134 respectively and independently electrically connected to the control system 54 as illustrated in FIG. 5, or alternatively may be arranged with the pumps for the third and fourth reservoirs 118, 120 being connected to the same motor in a similar manner as shown with regard to pumps 48 and 50 and common motor 52 for the conditioner application system 14. Preferably, the pumps 126 and 130 are fluid metering or peristaltic pumps, which supply liquid to the cleaning liquid dispensing head in constant volume slugs. The output of pumps 126 and 130 may be manually adjustable or electronically adjusted by signals from the control system 54, whereby the ratio of cleaning liquid constituent components from the third and fourth reservoirs by the pumps may be adjusted, and similarly the motors 134 for each of the pumps 126 and 130 may be electronically controlled by the control system 54 to vary the volume of liquid delivered by each pump 126, 130. The provision of separate third and fourth reservoirs 118, 120 enables the maintenance worker to fill each reservoir with separate cleaning liquid constituents without premixing. However, if desired to use a premixed cleaning solution or water only, a connecting pipe 136 may be provided which fluidically connects the third reservoir 118 and the fourth reservoir 120 and has a valve 138 which may permit or deny the passage of liquid through the connecting pipe 136. This provides flexibility for lane maintenance operators to use the full capacity of the tank 114 either to have pumps 126 and 130 provide the cleaning liquid via conduits 140, 142 to respective three-way or relief valves 144, 146, then via the cleaning system supply hoses 90 and 92 to the mixing junction 88 where different constituents may be mixed and then to the cleaning liquid dispensing head 86 for disposition on the bowling lane by the discharge tub 94 and tip 96. Alternatively, the operator may choose to apply water only or premix the cleaning liquid, and in that circumstance may maximize the capacity of the tank 114 by opening the valve 138 to permit liquid to flow between and equalize levels in the third and fourth reservoirs 118, 120. The relief valves 144, 146 are provided with return conduits 148, 150 for returning the respective cleaning liquid constituents to their respective reservoirs 118, 120, and each reservoir may be provided with its own vent 151. If return of one or both of the cleaning liquid constituents to its associated third or fourth reservoir 118, 120 is not desired, the associated return conduit 148, 150 may be omitted.

The cleaning system 12 preferably may include a wiping assembly 152 located immediately behind cleaning liquid dispensing head 86 and a vacuum assembly including a vacuum pickup head 154 including a squeegee assembly with squeegee-type blades 156, both as disclosed in US Published Patent Application No. 2008/0109983. The control system 54 may include, as noted above, a programmable logic controller, a drive motor control, a printed circuit board and control relays, a key pad and display 160, as well as a start switch and an emergency stop switch. Electrical power to the machine 10 may be provided by a conventional 110 or 220 volt electrical power supply from a building's power outlet via an electrical extension cord or the like, and/or advantageously by a pair of series-connected 12 VDC rechargeable storage batteries 158 or a 24 VDC rechargeable storage battery.

The provision of the first and second reservoirs 44 and 46 and mixing junction 34 permits the machine 10 to advantageously deliver conditioners to the lane which should be stored separately until the time of delivery for optimizing effectiveness. Heretofore, all lane conditioners have been made using base oil; in most lane conditioner products the base oil is a mineral oil. While other base oils can be used, mineral oil is generally regarded as preferable for safety reasons due to casual contact with bowlers. Unfortunately, it has been learned that base oils have an equal attraction to the bowling ball and to the bowling lane. The use of today's modern bowling balls creates a problem with the use of base oils as lane conditioners in that they break down quickly, leading to changes in the way the bowling ball travels down the lane and how it retains kinetic energy to knock down the bowling pins.

As an alternative to oil-based products, some materials can be used as lubricants that do not have an attraction to modern bowling balls which have surface materials of synthetic resins such as polyethylene, polyurethane or the like. While the lubricants work better to condition the lane, they can create problems where the bowling ball comes into contact with the pinsetter. Some pinsetter parts are designed to move the bowling ball and these parts need or at least function better when there is some oil on the ball. If there is no oil on the ball, there is a high risk of damaging or creating operational problems for the pinsetter.

The present invention is intended to overcome the problems of the prior art by making it possible to provide an application of a lane conditioner comprised of constituent components which are incompatible in storage or are immiscible. Lubricants are polar compositions and mineral oil is non-polar, making a stable solution of these two constituents has so far not been possible in an acceptable lane conditioner. The present invention allows the application of a composite lane conditioner with the benefits of the polar lubricant while retaining the benefits of a non-polar, oil-based conditioner. This is accomplished by providing the separate first and second reservoirs 44 and 46 which respectively receive either (but not both) of the polar lubricant as a first quantity of lane conditioner component and the non-polar oil as a second quantity of lane conditioner component. The polar lubricant component may be selected from the group consisting of polyethylene glycols, particularly low molecular weight polyethylene glycols, and water-based lubricants consisting of glycol chemistry. The non-polar or oil-phase component may be comprised of any oil based product, and preferably a mineral oil based product. By way of example, the non-polar constituent or oil-based constituent may include pure mineral oil or commercially available oil-based lane conditioners such as those sold by Kegel, LLC under the trademarks Infinity™, Navigate™ and Prodigy™.

Operation

The operation of machine 10 is controlled by way of the programmed programmable logic controller of the control system 54. Although the machine 10 may be selectively operated through the use of appropriate switches to clean the lanes only, or to condition (i.e., apply conditioner to) the lanes only, in the following example the machine 10 is operated to both clean and condition the lanes.

Initially machine 10 is placed on the approach of a bowling lane just behind the foul line. The operator presses a start switch one time, which initiates the sequence of maintenance operations. A variety of lane conditioning patterns may be selected by way of the key pad and display 160, as is conventional. A duster unwind motor comes on at this time to dispense a new section of cloth, but if the normally open contacts of a duster up switch do not open up, there will be a "duster empty" error displayed. The squeegee assembly will move down and stop when the normally open contacts of the down switch close. If the switch contacts do not close, there will be a "squeegee did not lower" error displayed. The motor 52 also turns on.

The machine 10 is then pushed onto the lane and properly seated. The gutter guide wheels 80 will be positioned in the gutters on either side of the bowling lane to be cleaned and conditioned and help to guide and maintain alignment of the machine 10 during its travel down the lane (from the foul line to the pin deck) and back (the return trip from the pin deck to the foul line). In manual operation of machine 10, the start switch is then pressed a second time and the motors 68 and 106 for the conditioner dispensing head 28 and cleaning liquid dispensing head 86 will start up and cause both dispensing heads 28 and 86 to begin moving. In robotic operation of machine 10, the start switch need not be pressed a second time to initiate operation of motors 68 and 106. While the dispensing heads 28 and 86 may move independently, in this example conditioner dispensing head 28 moves from left to right, as the lane is viewed from the foul line looking toward the pin deck, while cleaning liquid dispensing head 86 moves from right to left.

Motors 134 for each of the liquid cleaner pumps 126 and 130 are also energized. This causes the respective cleaning liquid constituents in third and fourth reservoirs 118, 120 to be delivered to the mixing junction 88 wherein the constituent cleaning compositions intermix. The control system 54 may send a signal to each of the pumps 126 and 130 to adjust the relative amount of the constituent cleaning liquid components to be delivered to the mixing junction 88 and thus to the dispensing head 86. Also, the control system 54 may send a signal to the motors 134 to adjust their speed according to the desired volume of cleaning liquid constituents to be delivered by each of the pumps 126 and 130 and thus the total amount of the cleaning liquid to be provided by the mixing junction 88 to the dispensing head 86.

The signals from the control system 54 to the motors 134 and pumps 126 and 130 may change their operation such that the ratios of the cleaning liquid constituent components or the total amount of cleaning solution is varied as the machine 10 moves along the lane. Thus, as liquid cleaner dispensing head 86 starts to move, it also starts to apply cleaning liquid instantly to the lane and this operation may continue until the last programmed "squirt distance" down the lane has been reached—the distance being measured by the lane engaging distance sensor wheels 78 and communicated to the control system 54 by signals generated by the sensor located proximate to the distance sensor wheels 78 or their shaft.

When the conditioner dispensing head 28 reaches a board edge proximity switch, in this example a right board edge proximity switch, and the cleaning solution dispensing head 86 reaches a board edge proximity switch, in this example the left board edge proximity switch, the heads 28 and 86 will reverse their direction, at which time the buffer motor starts to rotate the buffer 26 and the drive motor 22 is energized to start the machine 10 moving down the bowling lane.

A vacuum motor which is part of the vacuum assembly and which has remained in an "off" condition during the initial start-up phase, begins operation when the machine 10 has traveled about two feet down the lane. Also, after the start switch has been pressed the second time, the machine 10 may start a clock to record the total amount of run time on the display 160. The total amount of time that the pumps 48 and 50 dispense conditioner for each lane may be shown on the display 160. As the machine travels forward down the lane, the conditioner dispensing head 28 and the cleaning liquid dispensing head 86 may continue to operate, applying oil and cleaner, or alternatively if desired, the conditioner dispensing head 28 may be stationary and only the cleaning liquid dispensing head 86 may reciprocally travel along its guide track so that only cleaning liquid is applied. A board counting sensor 76, 112 operably associated with each of the dispensing heads 28, 86 respectively monitors the positions of the moving dispensing heads 28, 36 and if the motion is interrupted during intended operation (as opposed to intended cessation of operation of, for example, the conditioner dispensing head 28 during forward travel down the lane if desired in that mode of operation), an error message will be displayed on the display 160.

During movement of the machine 10 down the lane, the lane distance sensor which senses rotation of the distance sensor wheels 78 counts inches traveled and monitors movement of the machine 10. If travel is interrupted, an error message will be displayed. The speed of the machine 10 is also being monitored by the speed tachometer and may be displayed continuously. As the machine 10 continues to move forward, speeds may change (through a drive motor speed control, by way of example a KB model KBBC-24) and cleaning liquid and also possibly lane conditioner may continue to be dispensed along the lane as programmed. As noted previously, conditioner may be applied to a bowling lane in patterns, with increased conditioner having been or being applied at different board distances across the width of the lane as well at different distances along the lane from the foul line towards the pin deck.

Advantageously, the control system 54 may signal the cleaning system motor(s) 134 and pumps 126, 130 to either increase or decrease the ratio of a concentrate to water composition and/or to increase or decrease the total amount of cleaning solution to be applied to different areas of the lane in order to most efficiently and effectively clean the lane. As the machine 10 approaches the applied conditioner distance in accordance with the selected program, the conditioner pump motor 52 and the reversible motor 68, if then operating, turn off, but the buffer motor stays on so that the buffer 26 continues to rotate and buff the applied conditioner into the lane for a prescribed distance.

When the prescribed distance after the applied conditioner distance is reached, buffer 26 stops rotation and a buffer lift motor is energized to raise buffer 26 off the lane until a buffer up limit switch is operated. If the contacts for raising the buffer 26 do not close, there will be an error message displayed. If the buffer up limit switch sticks closed when it should be open, a "brush down" error message will be displayed.

Additionally, and provided that conditioner is being applied to the lane during the forward passage of the machine 10 down the lane, when the prescribed distance after the applied oil distance is reached, the machine 10 will switch into high speed and continue to travel toward the pin deck. As the machine 10 approaches the pin deck, the programmed distance for application of the cleaning liquid will be reached, causing motors 134 for each of the liquid cleaner pumps 126 and 130 to be turned off and the cleaning liquid delivery head reversible motor 106 to be de-energized so as to stop movement of dispensing head 86. At the same time, the machine 10 will downshift to a low speed mode to reduce its momentum to the pin deck.

At the pin deck, the machine 10 may operate the squeegee assembly and drive motor as well as the cleaner pump motors 134 in the manner described in published US Patent Application No. 2008/0109983, including to reverse the pumps 126 and 130 for a short preselected time period to eliminate any potential for cleaning liquid to drip onto the bowling lane during reverse travel of the machine 10. Thereafter, the machine 10 is ready to travel in reverse direction down the lane.

As the machine 10 travels in reverse, i.e. from the pin deck toward the foul line, the lane distance sensor counts inches traveled and continuously monitors movement of the machine 10. If travel is interrupted, an error message will be displayed. As the machine 10 reaches the applied conditioner distance in the reverse path, buffer 26 begins to lower and stops in the down position when the normally open contacts of the buffer down switch close. If the contacts do not close, an error message is displayed. If the down switch sticks closed when it should be open, a "brush up" error message will be displayed.

The buffer motor is then energized, causing buffer 26 to begin rotating and buffing as the machine 10 continues its travel in reverse. If conditioner was not applied on the forward travel of the machine, or if additional conditioner is desired to be applied to the bowling lane according to the pattern selected by the operator, the motor 52 causes pumps 48 and 50 to deliver conditioner components stored in the first and second reservoirs to dispensing head 28 through the mixing junction 34 such that head 28 starts dispensing conditioner when the machine 10 reaches the applied conditioner distance or the first "reverse load" distance on the lane according to the selected oil pattern program. The machine 10 progressively downshifts to lower speeds as it continues toward the foul line. When the last conditioner is to be applied (either as an initial or as an additional "reverse load" application), the conditioner dispensing head 28 stops and parks.

Once the machine 10 reaches the foul line 10, the drive motor 22 is deactivated, causing the machine to stop and await operator attention to move it to the approach of the next lane, or to automatically move on to the approach and index to the next lane as shown and described, for example, in U.S. Pat. No. 6,615,434, the entire disclosure of which is incorporated herein by reference, or in accordance with the zero turning radius machine and its operation as shown and described in Published U.S. Patent Application No. 2008/0109983 A1.

If at any time during its travel up and down the lane the machine 10 stops and displays a "LOW BATTERY OR E-STOP PRESSED" warning, this means either battery voltage has dropped below seventeen volts or the emergency stop switch has been pressed. In either case, the machine will need to be returned to the foul line and connected to a 120 or 220 VAC house power supply for recharging or running on house current using an electrical supply cord.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. In a lane maintenance machine that is operable to travel up and down successive generally parallel, elongated bowling lanes performing a maintenance operation on each lane, the improvement comprising:

a plurality of separate conditioning component reservoirs carried on the machine for separately storing constituent conditioning components;

at least one conditioner dispensing head for receiving and the dispensing the constituent conditioning components;

at least one pump associated with the separate conditioning component reservoirs and operable to pump the constituent conditioning components from the separate conditioning components reservoirs to the at least one conditioner dispensing head;

a buffer for receiving the constituent conditioning components dispensed from the at least one conditioner dispensing head and applying the constituent conditioning components to a bowling lane in a preselected pattern;

a cleaning liquid component reservoir carried on the machine for storing a cleaning liquid;

at least one cleaning liquid dispensing head for receiving and then dispensing the cleaning liquid;

a control system operably coupled with the at least one pump to cause the pump to concurrently pump the constituent conditioning components to the at least one conditioner dispensing head to allow concurrent dispensing of each of the constituent conditioning components onto the buffer; and a first mixing junction fluidically coupled with the separate conditioning component reservoirs for mixing together the constituent conditioning components and delivering the mixed constituent conditioning components to the at least one conditioner dispensing head.

2. The lane maintenance machine of claim 1, including primary and secondary drive wheels on opposite sides of the machine and positioned forwardly of the buffer in an intended forward direction of travel of the machine on the bowling lanes.

3. The lane maintenance machine of claim 1, including another conditioner dispensing head, wherein one of said conditioner dispensing heads is fluidically coupled with only one of said conditioning component reservoirs and the other of said conditioner dispensing heads is fluidically coupled with only another one of said conditioning component reservoirs so that said constituent conditioning components are not mixed together prior to being dispensed from said conditioner dispensing heads.

4. The lane maintenance machine of claim 1, including another one of said cleaning liquid component reservoirs for separately storing a component of said cleaning liquid.

5. The lane maintenance machine of claim 1, including a second mixing junction fluidically coupled with the cleaning liquid component reservoirs for mixing the cleaning liquid and delivering the mixed cleaning liquid to the at least one cleaning liquid dispensing head.

6. The lane maintenance machine of claim 1, including a strip brush positioned to receive the constituent conditioning components dispensed from the at least one conditioner dispensing head and deliver it to the buffer and a transfer roller positioned to engage the buffer and smooth out the constituent conditioning components when received on the buffer.

7. The lane maintenance machine of claim 1, including constituent conditioning components separately stored in said plurality of separate conditioning component reservoirs, wherein said constituent conditioning components are incompatible in storage or are immiscible, and including cleaning liquid stored in said cleaning liquid component reservoir.

8. In a lane maintenance machine that is operable to travel up and down successive generally parallel, elongated bowling lanes performing a maintenance operation on each lane, the improvement comprising:

a plurality of separate conditioning component reservoirs carried on the machine for separately storing constituent conditioning components;

at least one conditioner dispensing head for receiving and then dispensing the constituent conditioning components;

at least one pump associated with the separate conditioning component reservoirs and operable to pump the constituent conditioning components from the separate conditioning components reservoirs to the at least one conditioner dispensing head;

a buffer for receiving the constituent conditioning components dispensed from the at least one conditioner dispensing head and applying the constituent conditioning components to a bowling lane in a preselected pattern;

a cleaning liquid component reservoir carried on the machine for storing a cleaning liquid;

at least one cleaning liquid dispensing head for receiving and then dispensing the cleaning liquid;

a control system operably coupled with the at least one pump to cause the pump to concurrently pump the constituent conditioning components to the at least one conditioner dispensing head to allow concurrent dispensing of each of the constituent conditioning components onto the buffer;

a first mixing junction fluidically coupled with the separate conditioning component reservoirs for mixing together the constituent conditioning components and delivering the mixed constituent conditioning components to the at least one conditioner dispensing head; and primary and secondary drive wheels on opposite sides of the machine and positioned forwardly of the buffer in an intended forward direction of travel of the machine on the bowling lanes.

9. The lane maintenance machine of claim 8, including another conditioner dispensing head, wherein one of said conditioner dispensing heads is fluidically coupled with only one of said conditioning component reservoirs and the other of said conditioner dispensing heads is fluidically coupled with only another one of said conditioning component reservoirs so that said constituent conditioning components are not mixed together prior to being dispensed from said conditioner dispensing heads.

10. The lane maintenance machine of claim 9, including another one of said cleaning liquid component reservoirs for separately storing a component of said cleaning liquid.

11. The lane maintenance machine of claim 10, including a second mixing junction fluidically coupled with the cleaning liquid component reservoirs for mixing the cleaning liquid and delivering the mixed cleaning liquid to the at least one cleaning liquid dispensing head.

12. The lane maintenance machine of claim 11, including constituent conditioning components separately stored in said plurality of separate conditioning component reservoirs, wherein said constituent conditioning components are incompatible in storage or are immiscible, and including cleaning liquid stored in said cleaning liquid component reservoir.

13. The lane maintenance machine of claim 12, including a strip brush positioned to receive the constituent conditioning components dispensed from the at least one conditioner dispensing head and deliver it to the buffer and a transfer roller positioned to engage the buffer and smooth out the constituent conditioning components when received on the buffer.

14. In a lane maintenance machine that is operable to travel up and down successive generally parallel, elongated bowling lanes performing a maintenance operation on each lane, the improvement comprising:

a plurality of separate conditioning component reservoirs carried on the machine for separately storing constituent conditioning components;

constituent conditioning components separately stored in said plurality of separate conditioning component reservoirs, wherein said constituent conditioning components are incompatible in storage or are immiscible;

at least one conditioner dispensing head for receiving and then dispensing the constituent conditioning components;

at least one pump associated with the separate conditioning component reservoirs and operable to pump the constituent conditioning components from the separate conditioning components reservoirs to the at least one conditioner dispensing head;

a buffer for receiving the constituent conditioning components dispensed from the at least one conditioner dispensing head and applying the constituent conditioning components to a bowling lane in a preselected pattern;

a cleaning liquid component reservoir carried on the machine and storing a cleaning liquid;

another one of said cleaning liquid component reservoirs and separately storing a component of said cleaning liquid;

at least one cleaning liquid dispensing head for receiving and then dispensing the cleaning liquid;

a control system operably coupled with the at least one pump to cause the pump to concurrently pump the constituent conditioning components to the at least one conditioner dispensing head to allow concurrent dispensing of each of the constituent conditioning components onto the buffer;

a first mixing junction fluidically coupled with the separate conditioning component reservoirs for mixing together the constituent conditioning components and delivering the mixed constituent conditioning components to the at least one conditioner dispensing head;

primary and secondary drive wheels on opposite sides of the machine and positioned forwardly of the buffer in an intended forward direction of travel of the machine on the bowling lanes; and a second mixing junction fluidically coupled with the cleaning liquid component reservoirs for mixing the cleaning liquid and delivering the mixed cleaning liquid to the at least one cleaning liquid dispensing head.

15. The lane maintenance machine of claim 14, including another conditioner dispensing head, wherein one of said conditioner dispensing heads is fluidically coupled with only one of said conditioning component reservoirs and the other of said conditioner dispensing heads is fluidically coupled with only another one of said conditioning component reservoirs so that said constituent conditioning components are not mixed together prior to being dispensed from said conditioner dispensing heads.

16. The lane maintenance machine of claim 14, including a strip brush positioned to receive the constituent conditioning components dispensed from the at least one conditioner dispensing head and deliver it to the buffer and a transfer roller positioned to engage the buffer and smooth out the constituent conditioning components when received on the buffer.

* * * * *